US006316708B1

(12) United States Patent
Küppers

(10) Patent No.: US 6,316,708 B1
(45) Date of Patent: Nov. 13, 2001

(54) HI-HAT INVENTION

(76) Inventor: Peter Küppers, Kaiserstiege 143, Gronau (DE), 48599

( * ) Notice: Subject to any disclaimer, the term of this patent is extended or adjusted under 35 U.S.C. 154(b) by 0 days.

(21) Appl. No.: 09/610,534

(22) Filed: Jul. 7, 2000

(30) Foreign Application Priority Data

Jul. 7, 1999 (DE) ..... 199 31 363

(51) Int. Cl.[7] ..... G10D 13/02
(52) U.S. Cl. ..... 84/422.3; 84/422.1; 84/422.2
(58) Field of Search ..... 84/422.3, 422.1, 84/422.2

(56) References Cited

U.S. PATENT DOCUMENTS

| | | | | |
|---|---|---|---|---|
| 4,177,709 | * | 12/1979 | Adams | 84/422.3 |
| 4,274,322 | * | 6/1981 | Cordes | 84/422.3 |
| 4,497,238 | * | 2/1985 | Dasovich | 84/421 |
| 4,528,888 | * | 7/1985 | Hoshino | 84/421 |
| 5,267,500 | | 12/1993 | Lombardi | 84/402 |

FOREIGN PATENT DOCUMENTS

| | | |
|---|---|---|
| 198 44 794 | 10/1999 | (DE) . |
| 1 001 515 | 5/1997 | (NL) . |

OTHER PUBLICATIONS

European Patent Office Search Report for Patent Application EP 00 11 4509 dated Mar. 6, 2001, Researcher: A. Anderson.

* cited by examiner

*Primary Examiner*—Shih-Yung Hsieh
(74) *Attorney, Agent, or Firm*—James Creighton Wray; Meera P. Narasimhan

(57) ABSTRACT

A hi-hat 1 has available an operating unit 1 with the aid of which the upper cymbal dish 2 as well as the lower cymbal dish 4 can be moved. The upper cymbal dish 2 is for this reason allocated to a rod 7 which can, as is well known, be moved downward in relation to the lower cymbal dish 4 through the foot pedal 12. At the same time, the motion of the foot pedal 12 is guided through a cable line 13 and a guide pulley 14 such that a sheath tube 10 which bears the lower cymbal dish 4, is moved in the reversed direction, that is here upward, through appropriate connections. cylindrical springs 24, 25 and further safeties guarantee that overloading of the parts cannot occur.

14 Claims, 2 Drawing Sheets

HI-HAT INVENTION

BACKGROUND OF THE INVENTION

The invention concerns a hi-hat for generating percussion instrument sounds by cymbal dishes which can be set into motion, of which one cymbal is guided striking against the other cymbal dishes associated with a rod which is movable up and down in or on a stand.

Using convex shaped cymbal dishes, so-called cymbals, to generate specified noises by striking with sticks or adequate aids is known. These cymbals can likewise be struck against each other by hand, whereby two approximately equally large cymbals touch on their outer edges. This striking against each other is obtained in connection with the hi-hat, as is, for example, known from U.S. Pat. No. 5,267,500, that the upper cymbal is struck against the stationary lower cymbal with the aid of a rod which can be moved up and down. Such hi-hats belong to the standard outfitting of a percussionist, whereby he can either act directly through a foot pedal upon the rod, or as in U.S. Pat. No. 5,267,500, through a long activation cable which is arranged in a sheath. The typical and long lasting clash arises by striking the upper cymbal dish on the lower one. Hi-hats are used as rhythm instruments in concerts, as well as in connection with recording on sound carriers in the studio, which as a rule are operated in time by footwork of the percussionist. Usually a base drum or the like is operated with the other foot. With a hi-hat of this type, only the upper cymbal or cymbal dish can, as already mentioned, be struck against the lower stationary cymbal dish. Other noises can if necessary be reached by adding sticks or other aids. Further possible variations consist, if need be, in that cymbals of different size which emit different noises are used. Nonetheless, there has existed for years the intensive wish on the part of percussionists of generating different noises with one and the same hi-hat or of altering the intensity, even during a concert. Also, certain effects, as for example two staggered sounds, cannot be realized with the aid of known constructions. For this, one can, if worse comes to worse, rely on auxiliary technology in that the individual playing sessions are recorded on multiple tracks.

SUMMARY OF THE INVENTION

Underlying the invention is therefore the object of creating an instrument which can be played or actuated variably and in many ways.

The objective is accomplished in that the other cymbal dish, that is, the lower cymbal dish, can also be moved up and down and is constructed so that it can strike against the mobile cymbal dish, and for this reason is associated with a rod structure appropriately mounted in or on the stand.

The possibility of moving the lower cymbal dish leads to an additional possibility which simply cannot be attained in connection with previous hi-hats. The playing possibilities therewith increase whereby advantageously the focus can be on operating facilities which purely from the outside cannot be distinguished from the previous ones at all. With one and the same foot motion, either both cymbal dishes are brought against each other or, however, only to a certain point, in order then to be hit by the other, or in that one of the cymbal dishes is fixed and the other is struck against it. This specification makes clear that the solution of the invention offers a great number of different playing possibilities for a percussionist practiced to any extent which makes generating music additionally interesting and creates even more enjoyment than the activation of previously known hi-hats.

According to an appropriate refinement of the invention, it is provided that the rod which can be moved up and down is arranged with the upper cymbal dish inside the stand tube forming the stand, and the rod structure is constructed with the other, that thus lower cymbal dish, as the casing tube surrounding the stand tube and the rod. Correspondingly, the lower cymbal dish is moved opposite to the upper cymbal dish through the sheath tube or the rod structure, while the rod can be likewise moved up and down with the upper cymbal dish through one and the same foot pedal. As a rule, however, this motion takes place against each other in any given case, so that the appropriate noises can be generated with basically shorter motions, but also by appropriate variations and additions, different noises which were wholly unattainable with previous hi-hats. It was mentioned above that there are many possible variations whereby it is also conceivable to make both movable apart from each other by switching, so that the percussionist can strike the cymbal dishes lying together with the sticks in order to be able to operate the two cymbal dishes individually after moving them apart.

An especially appropriate construction of such an operating facility consisting of mechanical parts in connection with which the movable rod is joined flexibly with a foot pedal of a basically familiar construction, whereby this foot pedal at the same time acts upon a cable line which is joined with the sheath tube after guidance through a guide roller. This construction makes it possible to lead the two cymbal dishes against each other, and to be sure with the same foot pedal. As the same time, it can be assured by the operating facility that the two cymbal dishes selectively either hit each other while in motion or that the one has already reached its end position and the other then strikes upon it. Here it is important that the percussionist moves the rod for the upper cymbal dish downward while at the same time the sheath tube is guided upward with the same pedal motion. He thus requires only the single known pedal to operate both mobile cymbal dishes so that he can operate another musical instrument as before.

The correspondingly movable parts can be moved with the same foot because it is provided, according to a refinement of the invention, that the movable rod consists of a pedal element, a sheath element and a dish rod, that the pedal element is constructed as a tube accommodating the cable line, and the adjoining sheath element is constructed as an intermediate element enclosing the guide pulley and joined with the dish rod. Consequently, a continuous rod is no longer used, but rather such a mechanics which at the same time also guarantees the motion of the cable line and its guidance by the guide pulley so that thereby the downward motion of the rod with the upper cymbal dish is converted into an upward motion of the sheath tube with the lower cymbal dish.

With the mechanics described, the return of the two cymbal dishes into their initial position is also guaranteed at the same time in that the sheath tube with the other cymbal dish has a pedestal which is passed in a cylindrical tube enclosing the stationary stand tube and has a collar projecting outward which is mounted between cylindrical springs arranged in the cylinder tube. The corresponding cylindrical springs are appropriately clamped between the collar and other components of the cylinder, and they are designed so that a uniform elevating and depressing the cymbal dish or the sheath tube, and pressing the rod up are assured.

The force of the cylindrical springs can advantageously be adjusted, for which it is provided that the cylinder tube is joined clamping the cylindrical springs through a thread with a tray ring. Depending upon how far the cylinder tube is retracted through the thread on the tray ring, the counter pressure increases and the forces necessary to move the sheath tube must be correspondingly high. As a rule, these springs are proportioned so that only a swing back and an exact passage of the sheath tube is possible.

An excessive pressure or even damage is deliberately prevented in that the cable line is allocated a spring arrangement, the hardness of which lies above that of the cylindrical spring. Herewith it is guaranteed that when the sheath tube moves against the counter pressure of the cylindrical springs, the spring leads to an elongation of the cable line so that damage is avoided. The length and construction of the spring arrangement can be adapted to the relevant situation, whereby it is just as necessary to give the cable line a certain flexibility which prevents breaking away.

The motion of the lower cymbal dish can be altered if necessary, for example in the respect that it moves in the same direction as the upper cymbal dish. This is attained according to the invention in that the pedal element of the rod can be coupled directly with the sheath tube through a driver disk. In this way, the guidance of the motion of the pedal is shut off since the rod and the outer tube are joined to each other, therewith they also have to maintain the same direction of motion in any given case. Here it may be necessary to construct the cable line elastically to the extent that excessive pressure and breaking away do not occur.

The cable line guiding the motion of the foot pedal lies in the interior of the rod whose appropriate construction is hollow. Its motion must correspondingly be carried by the surrounding parts to the sheath tube. For this purpose, it is provided that the cable line is fastened to the sheath tube with its end on a cam cylinder, whereby the connecting cam penetrates a slot in the stand tube and is passed through it. At the same time, it is therewith assured that the sheath tube is securely guided in connection with its up and down motion and is secured against twisting, because the connecting cam protrudes through the slot and activates the guidance.

The distance between the two cymbal dishes can be altered in that the sheath tube is a telescoping tube whose end piece allocated to the other cymbal dish alterably forms the distance between the cymbal dishes and is outfitted with an appropriate clamp. The sheath tube is consequently constructed in two parts in the upper region, that is, in the end piece region, whereby these two parts are constructed so that they can be slid into each other and be attached in various positions. The clamp serves this purpose.

In addition to this, the distance between the cymbal dishes can advantageously be altered in that the upper is separably connected with the rod and is constructed continuously slidable on the latter. For this purpose, it has available on the upper edge a screw clamp which makes attachment on the rod possible and at different heights.

The facility described above makes it possible to move the two cymbal dishes against each other, as well as the described motion of both cymbal dishes through the mechanics. Actuating the guide pneumatically or hydraulically is also conceivable whereby a pneumatic guide and operation of the hi-hat becomes possible, in that a piston is allocated to the rod whereby the stand tube serves as a cylinder housing with an upper and a lower cylinder chamber of which the lower cylinder chamber is sealed off against the atmosphere and stands in connection with an air chamber formed between the outer wall of the stand tube and the slidable sheath tube, in which a rotary piston allocated to the sheath tube is arranged in a sliding fashion. Upon moving the rod, or in connection with operating the foot pedal, compressed air or air is compressed in the lower cylinder chamber through the cylinder allocated to the rod and then pressed into the corresponding air chamber so that the rotary piston arranged therein must yield and thereby takes the sheath tube and consequently the lower cymbal dish along with it. This construction has the advantage that a very soft striking of the lower cymbal dish can be brought about because a "compressed air spring" is created. Further auxiliary facilities can be dispensed with here, which has the great advantage that the construction is comparatively simple despite the "pneumatics."

Dishes supporting the lower cymbal dish are known which can be made of a material having suitable low springing properties. With such a construction, the sheath tube is rigidly joined with the supporting dish and therewith to the lower cymbal dish. A certain springing of the lower cymbal dish is possible in this way.

With the aid of a refinement of the invention, a selective springing and at the same time an overstep safety is obtained in that the sheath tube has a supporting dish constructed in two parts with a tube-like attachment in which a vibratory spring is arranged between two part elements. This vibratory and retaining spring ensures that when the two cymbal dishes strike upon each other and "motive force" is exerted upon the foot pedal, no damage occurs because the corresponding retaining spring or vibratory spring is compressed without it being possible for a problem or damage to arise. Appropriately it is, however, provided that the part element which is slidable against the cymbal dish is constructed with an upper catch as the oscillating tube encasing the vibratory spring. The catch prevents the clamped vibratory spring from being overstressed or damaged.

The invention is especially distinguished in that a hi-hat is created which has considerably more possible variations than known standard hi-hats. First there is the possibility of moving and striking not only one dish against the other, chiefly the upper against the lower, but rather upper and lower cymbal dishes can now be guided against each other selectively in order to obtain different sounds. Through adroit and simple adjustment possibilities, a great number of sounds can be obtained than was possible with the known hi-hats. The distance between the two cymbal dishes can be altered, damaging the two cymbal dishes is prevented by a vibratory spring or a retaining spring, and the entire mechanics is so simply built up that the parts which can be moved against each other are arranged in a protected fashion such that they represent no hindrance or danger for the percussionist.

Further particularities and advantages of the object of the invention emerge from the following description of the associated drawings in which a preferred embodiment is represented with the necessary details and individual components, wherein:

DETAILED DESCRIPTION

Figure 1:
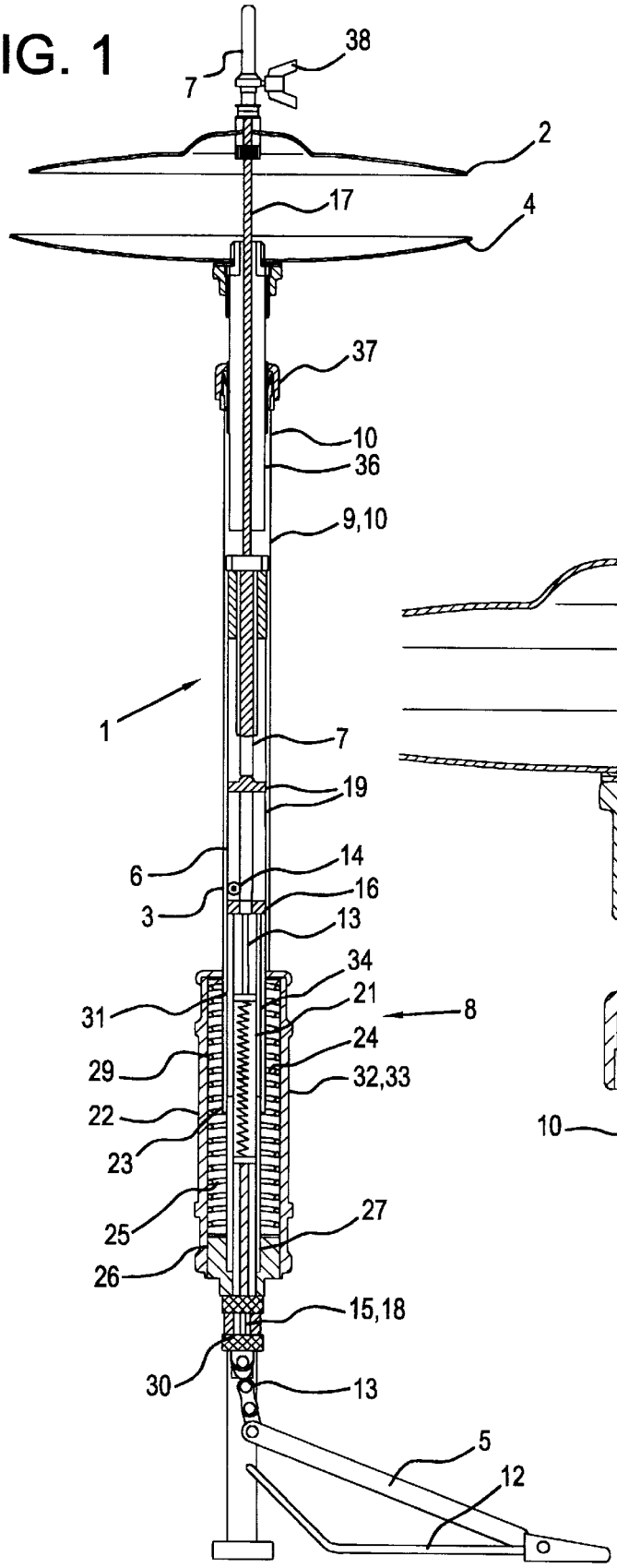
FIG. 1 Represents a hi-hat in lateral view with operating mechanics in section, FIG. 2 Shows the upper part of the hi-hat with the two cymbals and the elongation possibility of the sheath tube, FIG. 3 Illustrates the upper part of the sheath tube with the supporting dish and a retaining spring, FIG. 4 Reveals the supporting dish with tube-like attachment without retaining spring and FIG. 5 Shows a pneumatic operating facility in schematized reproduction for a hi-hat.

The hi-hat11 reproduced in FIG. 1 consists of the operating facility 8 and the two dishes 2, 4. These two cymbal dishes 2, 4 are allocated to the upper end of the stand 3 and are movable against each other, as will be explained again below. The driver disk 5 in the form of a foot pedal 12 is situated at the lower end of the service facility through which the upper cymbal dish 2 can be moved downward and the lower cymbal dish 4 can be moved upward.

The rod 7 carrying the upper cymbal dish 2 is arranged in a sliding fashion in the stationary stand tube 6, whereby this rod, as will be further explained below, is constructed in several parts. The rod structure 9 carrying the lower cymbal dish 4 is constructed in the form of a sheath tube 10 in order once again to be able to accommodate the rod 7 and the stand tube 6 and to move the lower cymbal dish 4 lying above up and down.

While the driver disk 5 or the foot pedal 12 acts directly on the upper cymbal dish 2 through the pedal element 15, the casing element 16 and the dish rod 17, the same direction of motion of the foot pedal 12 is used to act on the sheath tube 10 or the rod structure 9 as well through a cable line 13 which is passed about the guide pulley. Here the pedal element 15 consists of a tube 18, while the casing element 16 is constructed as an intermediate element 19 in which the guide pulley 14 for the cable line 13 is accommodated. The cable line 13 is centrally accommodated within the pedal element 15 and is joined with sheath tube 10 at the other end 31 through a cam cylinder 32. The cam cylinder 32 has available connection cams 33 which reach through the stand tube 6 and the pedal element 15 as well. A slot 34 is provided for this purpose.

In the area of the foot element 21 of the sheath tube 10, this is provided with a collar 23, whereby this collar 23 is mounted between two cylindrical springs 24, 25 in a cylinder tube 22 which is closed above and below so that the cylindrical springs 24, 25 can brace themselves against it. The foot element 21 of the sheath tube 10 is therewith evenly guided independently of whether the sheath tube 10 is moved upward or downward. The appropriately cylindrical springs 24, 25 ensure the necessary uniform guidance in both directions and also that the collar 23 and therewith the sheath tube 10 swing back into the initial position if the percussionist takes his foot off the foot pedal 10 or appropriately releases this foot pedal 12.

The cylindrical springs 24, 25 can be prestressed in that the lock of the cylinder tube 22 below is formed by a tray ring 27 with a thread 26. The cylinder tube 22 can therewith be moved more or less far above this tray ring 27 in order to adjust the prestressing of the cylindrical springs 24, 25 to the requirements in question appropriately.

Should the lower cymbal dish 4 be moved in the same direction as the upper cymbal dish 2, then it is possible to slide it by loosening the clamp 37 and to join the sheath tube 10 directly with the rod 7 or the cable line 13 through the driver disk 30 and the remaining elements necessary for this. This way, it is ensured that both cymbal dishes can vibrate in the same direction. In order to avoid an overstressing of the cable line 13, a spring arrangement 29 is provided, whereby the hardness of this spring arrangement 29 lies clearly above that of the cylindrical springs 24, 25. It is therewith assured that this spring arrangement 29 also prevents overstressing the cable line 13 without the sheath tube 10 being blocked in connection with its motion.

The distance between the two cymbal dishes 2, 4 can, as explained above, be altered by a clamp 37 in that the end piece 36 of the sheath tube is correspondingly constructed as insertable and is fixable in various positions. In addition, there exists the possibility of sliding the upper cymbal dish 2 in the direction of the lower cymbal dish 4 or in the reversed direction with the aid of the screw plate 38. For this reason, the rod 7 also projects a certain stretch over the upper cymbal dish 2.

Figure 2:
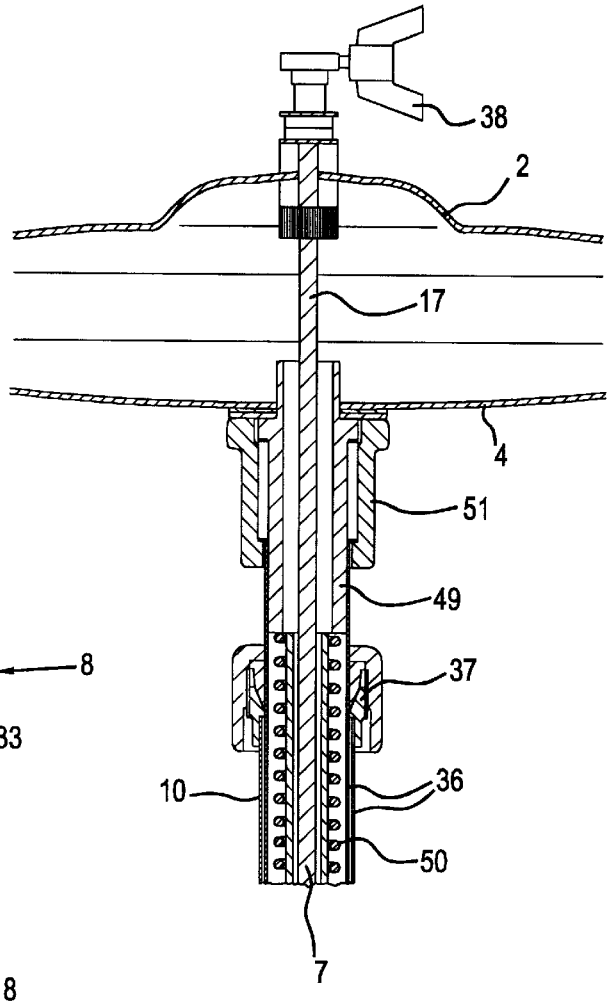
Figure 3:
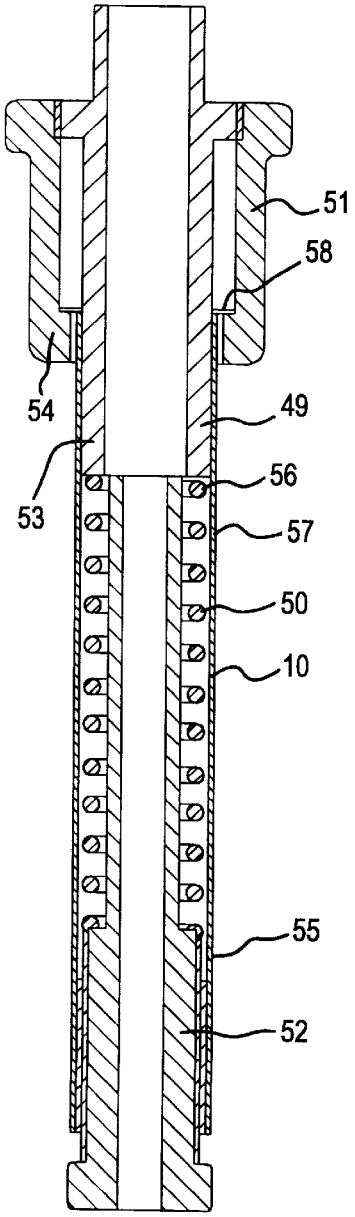

In deviation from the representation according to FIG. 1, a refinement is provided in FIG. 2 to the extent that a two part construction of the supporting tube 49 is represented in which a retaining spring 50 or a vibratory spring 56 is accommodated. This supporting tube 49 is similar to the tube-like attachment 53, and the vibratory spring 56 is therewith accommodated inside the two part elements which can slide in relation to each other which is clamped between the return bearing 52 and the supporting dish 51 and ensures that with an overstep, that is, with a downward motion of the foot pedal 12 after the two cymbal dishes 2, 4 have struck together, damage cannot occur. An overstress of the vibratory spring is prevented by the stop 58 which forms the upper end of the oscillating tube 57, thus part element 55. This special arrangement is reproduced enlarged in FIG. 3.

Figure 4:
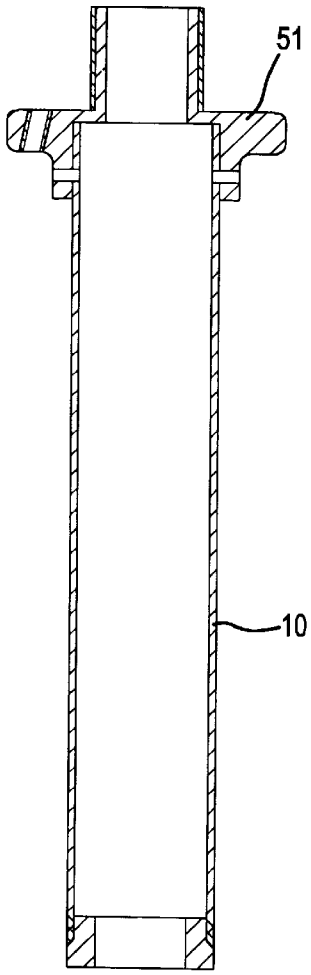

FIG. 4 shows a construction in connection with which the cymbal dish 4 is rigidly arranged on the supporting dish 51, thus being unable to yield springing upon an overstep.

Figure 5:
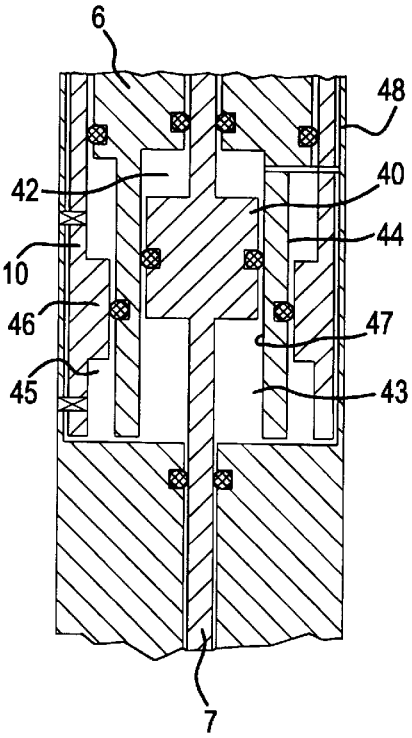

FIG. 5 depicts another construction of the present invention to the extent that here a pneumatic operating facility is reproduced. The motion of the rod 7 is converted by a piston-cylinder chamber construction and transmitted to the sheath tube 10. It can be gathered from FIG. 5 that it is a question of a thickening of the rod 7 with the piston whereby the generation of air pressure is assured in that the piston is provided with O rings on the edge side. In this way, a pressure arises in the cylinder housing 41, and indeed in the lower cylinder chamber 43, while with a reversed motion the compressed air can flow out of the upper cylinder chamber 42. Here a channel is provided which joins the upper cylinder chamber 42 with the atmosphere.

The compressed air which is generated by the downward motion of the piston 40 flows through the boreholes retained in the region of the lower end of the stationary stand tube 6 into an air chamber 45, whereby this air chamber 45 is bounded by a rotary piston 46 which is part of the sheath tube 10. The rotary piston 46 is consequently subjected to high pressure by the compressed air and therewith also the sheath tube 10 and also the lower cymbal dish 4. An O ring is sunk into the outer wall 44 of the stationary stand tube 6 in order to force the necessary sealing in this region. The interior wall 47 of the stand tube 6 is not retained here because this interior wall 47 serves as an interior wall of the lower cylinder chamber 43.

The elements of the cylinder housing 41 are accommodated in a exterior tube 48 in this region which as such is stationary and thereby practically part of the stand tube 6.

All features mentioned, even those which can be gleaned from the drawings alone, are viewed as essential to the invention alone and in combination.

What is claimed is:

1. Hi-hat device for generating percussion sounds comprising a stand, a rod slidingly coupled to the stand for moving on the stand, a vibratable upper cymbal dish, a vibratable lower cymbal dish, each of the upper cymbal dish and the lower cymbal dish being movably disposed relative to each other, the upper cymbal dish positioned on the rod for moving up and/or down with the rod and striking against the lower cymbal dish, a rod structure coupled to the stand, and the lower cymbal dish positioned on the rod structure for moving up and/or down and striking against the upper cymbal dish, a stand tube forming the stand for receiving the rod and wherein the rod structure is a sheath tube surrounding the stand tube and the rod.

2. The device of claim 1, further comprising a foot pedal, the rod being flexibly joined with the foot pedal, a cable coupled to the sheath tube, a guide pulley for guiding the cable, wherein the foot pedal acts on the cable.

3. The device of claim 2, further comprising a tubular pedal member forming the rod, a sheath member and a dish rod, for accommodating the cable, wherein the sheath member is joined to the dish rod and forms an intermediate element for enclosing the guide pulley.

4. The device of claim 3, further comprising a foot member coupled to the sheath tube, a cylindrical tube surrounding the stand tube and guiding the foot member, and the cylindrical tube comprising cylindrical springs and an outwardly biased collar disposed between the sprines.

5. The device of claim 4, further comprising a tray ring joined to the cylindrical tube, and a thread on the tube such that the tray ring clamps the cylindrical springs through the thread.

6. The device of claim 3, further comprising a driver disk for directly coupling the pedal member of the rod with the sheath tube.

7. The device of claim 4, further comprising a spring assembly coupled to the cable, wherein the spring assembly is disposed above the cylindrical springs.

8. The device of claim 1, further comprising a cam cylinder for coupling the cable on the sheath tube with an end passing through the cam cylinder, a connecting cam penetrating a slot in the stand tube and passing the cable therethrough.

9. The device of claim 1, wherein the sheath tube is a telescoping tube having an end piece coupled to the lower cymbal dish for changing a distance between the upper and the lower cymbal dishes and a clamp coupled to the end piece.

10. The device of claim 1, wherein the upper cymbal dish is separably joined with the rod and is continuously slidable on the rod.

11. The device of claim 1, further comprising a piston coupled to the rod, the stand tube forming a cylindrical housing having upper and lower cylindrical chambers, the lower cylindrical chamber being sealed off against atmosphere and being connected to an air chamber between the outer wall of the stand tube and the slidable sheath tube, and a rotary piston coupled to the sheath tube being slidably disposed in the lower cylindrical chamber.

12. The device of claim 1, further comprising a supporting dish, wherein the sheath tube is joined rigidly with the supporting dish and with the lower cymbal dish.

13. The device of claims 12, wherein the supporting dish comprises two parts with attachments, and a vibratory spring disposed between the two part.

14. The device of claim 13, wherein one of the two parts is an oscillatory tube slidable against the cymbal dish, and comprising an upper catch surrounding the vibratory springs.

* * * * *